United States Patent [19]

Kikuchi

[11] Patent Number: 4,981,432

[45] Date of Patent: Jan. 1, 1991

[54] ELECTRICAL CONNECTOR

[75] Inventor: Shoji Kikuchi, Hiratsuka, Japan

[73] Assignee: AMP Incorporated, Harrisburg, Pa.

[21] Appl. No.: 555,338

[22] Filed: Jul. 19, 1990

[30] Foreign Application Priority Data

Jul. 27, 1989 [JP] Japan ..... 1-18233[U]

[51] Int. Cl.[5] ..... H01R 4/26

[52] U.S. Cl. ..... 439/417; 439/266; 439/499

[58] Field of Search ..... 439/260, 266, 267, 268, 439/410, 417, 435, 436, 493, 495, 499, 725, 728, 729

[56] References Cited

U.S. PATENT DOCUMENTS 3,395,377 7/1968 Straus ..... 439/267 X 4,410,228 10/1983 Stephenson ..... 439/436

4,647,131 3/1987 Van Woensel ..... 439/266

4,713,020 12/1987 Awano et al. ..... 439/267

4,921,439 5/1990 Bofill et al. ..... 439/417

*Primary Examiner*—Neil Abrams

*Assistant Examiner*—Khiem Nguyen

[57] ABSTRACT

An electrical connector (10) for receiving a ribbon cable (20) has been disclosed. The connector (10) includes a plurality of contacts (14) in a housing (11) and a cover (12) which is movable towards the contacts (14) to cam open wire retaining sections (15) thereon. The housing further includes projections (11*a*) which prevent the ribbon cable (20) from being bent over and pushing the cover (12) down to inadvertently release the wires (21) of the cable from the wire retaining sections (15).

1 Claim, 1 Drawing Sheet

ELECTRICAL CONNECTOR

FIELD OF THE INVENTION

The present invention relates to an electrical connector and more specifically to a device therein to prevent accidental release of the terminated wires therein.

BACKGROUND OF THE INVENTION

The type of electrical connector of concern is one having a number of contacts in side by side relation, carried in a housing wherein &:he contacts include a wire retaining section which is also the electrical engaging section. A cover mounted over the housing includes a camming surface for opening the wire retaining section and releasing the wires by being pushed down. Experience has shown however that by bending the wires across the top of the cover will depress the cover and cause the release of the wires from the retaining section and loose electrical connection. Accordingly it is now proposed to provide a device on the housing which will prevent bent wires from contacting and depressing the cover.

SUMMARY OF THE INVENTION

According to the invention an electrical connector is provided which includes a housing, a plurality of contacts in the housing and a cover on the housing for reciprocal movement. The cover, which has a slot through which a ribbon cable can pass, include camming surfaces to engage camming surfaces on resilient wire retaining sections on the contacts to release wires which have been inserted thereinto. Further, the housing includes projections extending through slots in the cover for preventing the ribbon cable from being bent over and pushing down on the cover inadvertently.

DESCRIPTION OF THE INVENTION

Figure 1:
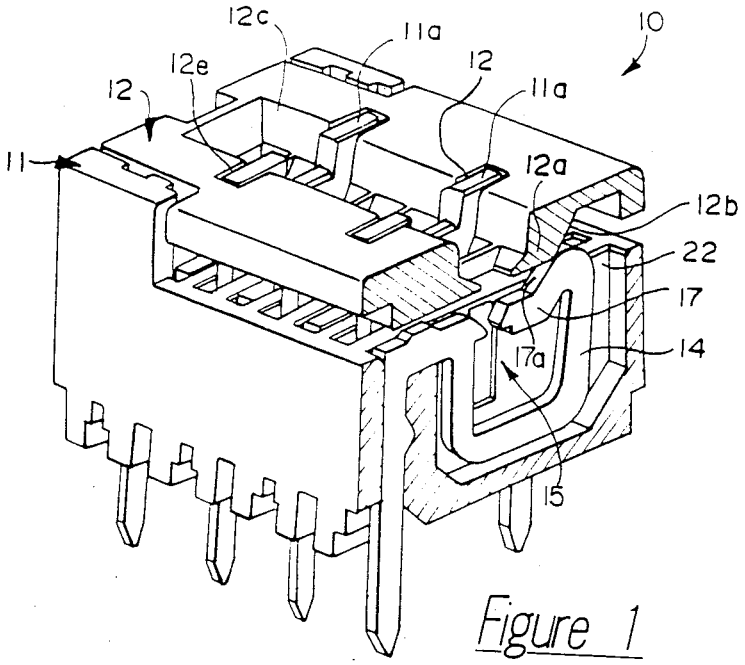
FIG. 1 is a partly sectioned, perspective view of an electrical connector according to the present invention.
Figure 2:
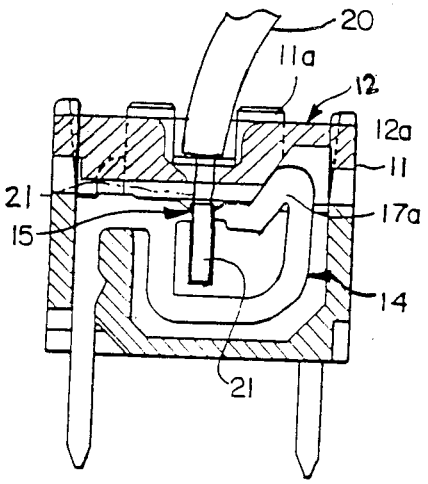
FIG. 2 is a end section view of the connector of FIG. 1 showing the wires of a ribbon cable inserted therein.

Electrical connector 10 as shown in FIG. 1 includes housing 11, cover 12 and contacts 14. Each contact 14 is positioned in a space isolated from adjacent contacts 14 by walls 22. Each contact 14 includes a wire retaining section 15 to retain wires 21 (FIG. 2) and to make electrical engagement therewith. Section 15 includes resilient hook member 17 and camming surface 17*a*. As shown in FIG. 2, wires 21 are inserted into Section 15 and retained by hook member 17 biting thereinto.

Spaced along the top of housing 11 and extending above contacts 14 are several projections 11*a*. These projections 11*a* may be continuations of select walls 22 or extend upwardly from the housing base.

Cover 12 includes a slot 12*c* through which wires 21 pass. Further, transverse slots 12*e* are provided to receive projections 11*a* as shown. On the underside, camming surface 12*b*, defined by projection 12*a*, engages camming surface 17*a* on contacts 14 and, as cover 12 is pushed down, hook member 17 is resilient pulled back to release its bite on respective wire 21.

FIG. 2 shows connector 10 with ribbon cable 20 inserted thereinto; i.e., wires 21 have been inserted into wire retaining sections 15 of contacts 14. Further, the drawing shows cable 20 bent over. However, before it can engage cover 12 it engages projections 11*a* and the depressing of cover 12 prevented.

As can be discerned, an electrical connector for ribbon cable has been disclosed which includes a cover mounted on a housing and movable downwardly to cam open the wire retaining sections on the contacts carried in the housing. Further, the housing includes projections which intercept a bending ribbon cable to prevent it from depressing the cover and inadvertently camming the wire retaining sections open and thereby release the wires.

I claim:

1. An electrical connector for ribbon cable having several wires, said connector comprising:

a housing having a plurality of spaces which are open outwardly on one surface;

a plurality of contacts disposed in respective spaces and having resilient wire retaining sections to receive and bite into respective wires inserted thereinto, said contacts further having a camming surface on said retaining sections;

a cover mounted on said one surface of said housing and movable reciprocally thereon, said cover including a slot for receiving a ribbon cable and camming surfaces engaging said camming surfaces on respective wire retaining sections so that by depressing the cover towards the contacts, the resilient wire retaining sections are cammed open to release the wires therein; and means on said housing and projecting outwardly from said one surface for engaging the ribbon cable which may be inserted into said slot in said cover and preventing contact with said cover.

* * * * *